US006131845A

United States Patent [19]

Burlingame et al.

[11] Patent Number: 6,131,845

[45] Date of Patent: Oct. 17, 2000

[54] FIBER GUIDE

[75] Inventors: Roger Francis Burlingame, Thousand Oaks; John E. Fitzgerald; Thomas G. Council, both of Camarillo, all of Calif.

[73] Assignee: Litton Systems Inc., Woodland Hills, Calif.

[21] Appl. No.: 09/127,331

[22] Filed: Jul. 31, 1998

Related U.S. Application Data

[63] Continuation-in-part of application No. 08/918,734, Aug. 1, 1997, Pat. No. 5,947,406.

[60] Provisional application No. 60/054,700, Aug. 4, 1997.

[51] Int. Cl.[7] ..... B65H 54/28

[52] U.S. Cl. ..... 242/476.7; 242/615.3; 242/157.1; 242/478.2; 242/920; 242/447.1; 242/447.2; 242/548.3

[58] Field of Search ..... 242/476.7, 615.3, 242/157 R, 157.1, 478.2, 483.3, 920, 447.1, 447.2, 447, 548.3

[56] References Cited

U.S. PATENT DOCUMENTS

| | | | |
|---|---|---|---|
| 1,941,250 | 12/1933 | Dale | 242/157.1 |
| 2,906,468 | 9/1959 | Wellcome | 242/484 |
| 4,179,083 | 12/1979 | Hara et al. | 242/478.2 |
| 4,428,540 | 1/1984 | Calcagno et al. | 242/478.2 |
| 4,856,900 | 8/1989 | Ivancevic | 356/350 |
| 4,884,764 | 12/1989 | Hill | 242/157.1 X |
| 5,009,353 | 4/1991 | Alquist | 242/157.1 X |
| 5,371,593 | 12/1994 | Cordova et al. | 156/425 |
| 5,405,485 | 4/1995 | Henderson et al. | 156/425 |
| 5,551,644 | 9/1996 | Londeroth | 242/478.2 |
| 5,564,637 | 10/1996 | Berthold et al. | 242/157.1 X |
| 5,695,105 | 12/1997 | Ohara | 242/615.3 X |
| 5,947,406 | 9/1999 | Burlingame | 242/478.2 |

*Primary Examiner*—Donald P. Walsh
*Assistant Examiner*—Minh-Chau Pham
*Attorney, Agent, or Firm*—James F. Kirk

[57] ABSTRACT

A fiber guide for spooling glass fiber from an automatic coil winding machine onto a spool. The guide has a body or pay guide assembly with a receiving aperture. Two similar sections are held together with a slight gap between them. Left and right parallel strands of music wire are tightly stretched through the gap across the receiving aperture of the arc and are anchored at each end. A spool with flanged edges receives the left and right parallel strands or guides and is maintained very close to the last layer or surface of fiber laid down. A guide pulley is carried by the guide for guiding glass fiber between the left and right parallel strands and onto the spool. The parallel strands are tensioned by anchoring each wire in a respective standoff. In one embodiment, each end of a music wire wraps around a standoff. The wires extend through the cross drilled holes permitting adjustment by turning the standoff. In an alternative embodiment, a tensioner is formed by a pivotal plate, relative to the guide. The pivotal plate tightens the left and right parallel strands by spring force generated by a spring connected between the pivot plate and the guide. In yet another embodiment, the left and right parallel strands are spaced apart by washers having a predetermined thickness and clamped.

21 Claims, 13 Drawing Sheets

FIBER GUIDE

This application is a Continuation-In-Part of U.S. Pat. No. 08/918,734 filed Aug. 1, 1997, now U.S. Pat. No. 5,947,406 and 60/054,700 filed Aug. 4, 1997 each for a "FIBER GUIDE" the common inventor being Roger F. Burlingame and the common assignee being Litton Systems Inc.

This invention was made with support under Contract No. N66001-95-C-6027 awarded by the U.S. Department of the Navy, Naval Research and Development. The Government of the United States of America has certain rights in this inventions.

FIELD OF INVENTION

The present invention is a fiber guide for use on an automatic coil winding machine in the manufacture of fiber optic coils useful in fiber optic gyros. The invention accurately guides and positions the optical glass fiber as it is coiled onto a spool such as a fiber optic coil for use in a fiber optic gyro or rate sensor.

RELATED ART

A fiber guide, called a pizza cutter, is the closest related art known. While winding a fiber coil, the fiber must be guided to make contact with the side walls (flanges) of a spool or coil form or bobbin comprising a spindle on which the coil is wound and in most cases at least one flange. The fiber guide, used to control the point of deposit of the fiber onto the surface of the coil, must be made as thin as practical so it can lay fiber close to the flanges. Minimum size of the fiber guide is determined by the radius of the spindle upon which the fiber is being wound plus the flange extending beyond the spindle.

Stated another way, the fiber guide radius plus the spindle radius must exceed the spindle flange radius. The rotational axis of the fiber guide must be located outside of the flange circumference. Larger diameter fiber optic coils will require large spool diameters and even larger associated guide wheel diameters. As the diameter of a pizza cutter wheel type guide is allowed to increase, the diameter of the guide wheel and the continuing requirement for the thickness of the wheel to be thin, so as to be able to approach the flanges, combine to cause the wheel to deflect or deform slightly resulting in a loss of precision in the deposition of the fiber forming the coil. It is difficult to fabricate a wheel of large diameter because as the diameter is increased, maintaining the wheels flatness under load becomes very difficult. As flatness is lost, the wheel will start to wobble and interfere with the precise deposition of optical fiber onto the top layer of fiber on the coil being fabricated.

The present invention is not limited by the diameter of the side walls or the flanges and is capable of being used to manufacture large diameter fiber optic coils. In addition, the present invention is more robust in comparison to the prior art. It can tolerate impacts against the spool flange without damage due to compliance of the wire strands where the prior art would deform or become dented or out-of-flat.

Additionally, the fiber often tends to "pop-out" of the pizza cutter style prior art guide wheel during use. This condition is eliminated with the present invention.

SUMMARY OF THE INVENTION

The invention comprises a fiber guide for spooling fiber optic or glass fiber from an automatic coil winding machine onto a target rotating spool. This invention fiber guide may find employment in other applications in which other forms of fiber, filament or wire, such as magnet wire, must be accurately guided onto a rotating flanged spool.

A first embodiment of the invention fiber guide comprises in combination; a rigid body. The rigid body, more particularly referred to as a pay guide assembly, is comprised of two parts with a gap between the parts. The parts are referred to as a left and right pay guide arm coupled together in opposing relation to form a mouth or receiving aperture shaped as an arc. Two parallel strands of wire are tightly stretched across the receiving aperture of the arc and anchored. They are spaced apart along the length of the pay guide assembly or opening of the mouth or receiving aperture. A spool for receiving the glass fiber is mounted or positioned so that it extends into the arc or aperture formed by the pay guide assembly and approaches the wire strands.

A guide pulley is carried or mounted in the pay guide assembly. The pulley operates to guide the fiber between the wire strands and onto a spool or fiber optic coil that is being fabricated for use in a fiber optic gyro or a hydrophone for use as an interferometer sensor in an acoustic application such as a towed array or a planar array.

The guide pulley is rotatably mounted on a guide pulley shaft. The guide pulley shaft is carried by the body or pay guide assembly. The guide pulley rotates on the shaft to guide the fiber from the winding machine onto the spool via the space between the wire strands. A guide pulley bearing means is positioned on the shaft for rotatably supporting the guide pulley. An adhesive means is used to fix the bearing means in a predetermined position to locate the guide pulley to direct the fiber between the strands. The adhesive means is typically a cyanoacrylic adhesive.

The predetermined position of the bearing means is manually adjusted to pre-load the bearing means to be substantially free of wobble, the pre-load being adjusted to a level at which a first slight deceleration is observed subsequent to and in response to manually spinning the guide pulley.

A method is provided for pre-loading a fiber guide pulley bearing means having a spaced apart right and left pay guide arm carrying a pulley shaft where the pulley shaft has right and left spaced apart bearings.

In this embodiment, the left and right parallel strands or guide wires are in the alternative, formed from piano or music wire.

In a first embodiment, a spacer washer or shim is fixed between the wires to fix the spacing of the wires to a predetermined width. In a second embodiment, the gap between the left and right pay guide arms is established by a spacer washer interposed between the wires at the top or bottom of the opposing hands plus the thickness of each of the wire strands, and any additional spacers that may be interposed between the wires and opposing surfaces of the respective pay guide arms.

Each of the embodiments have a means for anchoring the wire strands to the pay guide assembly, and a wire tensioning means carried by the pay guide assembly to tension the wire strands.

In each of the embodiments, the gap at the top and bottom of the pay guide assembly forms a top and bottom throat which is either open or closed to allow or stop insertion of fiber. It should be understood that at least one end must remain open, i.e. the space in the throat must be sufficiently unobstructed as to allow the passage of a fiber. With one end open, it is possible to pass the central portion of a fiber that is stored on two feed bobbins so that a winding machine can wind the fiber onto the fiber coil in alternate layers starting from the mid point of the length of continuous fiber. Quadrupole winding is done in this manner and the guide must have at least one end open for loading.

However, some applications, such as winding a mandrel on a hydrophone are wound starting at one end of a continuous fiber. In those applications, where the coil is wound from a first end of the fiber source, the fiber can be threaded through the wire strands or wire guides making it possible to have a fiber guide with both throats obstructed or closed.

Each respective throat has a respective first and second side separated by a predetermined distance. Each respective wire strand is in contact with a corresponding top and bottom side via direct contact or via a spacer or shim. Additional washers or spacers outboard of the wires and between the wires and sides of the throat may be used to protect the opposing surfaces of the throat or body.

The pay guide arm has a hole to receive a threaded end of a hollow threaded standoff. The hollow threaded standoff has a cross hole through the hollow threaded standoff body orthogonal to the axis of the body. A wire strand is passed through the hole and a rubber plug followed by a set screw is inserted into the hollow end of the hollow threaded standoff body and screwed into the hole until the rubber plug engages the wire strand passing through the cross hole preventing further movement of the wire. The wire strands are subjected to a predetermined pre-load to place them in tension before the set screw is tightened. The pre-loading step in combination with a hollow threaded standoff or other anchoring means combine to form a tensioning means.

In an alternative embodiment of the tensioning means a box or pair of pivot plates forming a box is pivotally connected to the pay guide assembly and to the left and right parallel strands or guide wires. A spring is connected between the plate and the pay guide assembly for drawing the wire into a tensioned condition. A threaded screw adjustably holds the spring to the box or plates forming a box. The threaded screw engages the box at a distance from the pivotal connection between the box and the pay guide assembly so as to apply a torque to the box as the distance between the box and the spring is shortened by operation of the threaded screw.

In each embodiment, the fiber guide comprises a pivotal connection between automatic coil winding machine and the pay guide assembly. A pay guide arm serves as a means for connecting the pivotal means on the winding machine and the pay guide assembly.

In each of the embodiments of the fiber guide, the spool or fiber optic coil onto which optical fiber is being wound, has a spool rotation axis and a predetermined window, similar in its characterization to the winding window formed by the bobbins or coil forms used by magnetic component production, for receiving fiber. The window is formed by the flanges at the ends of a coil form or spindle. The spindle has a surface that is typically cylindrical. A left and right flange each have an inner surface of predetermined height that extends above the spindle surface.

In each embodiment, the coil winding machine further comprises a servo means for moving the fiber guide parallel to the spool rotation axis as the spool or coil form is rotated. A guide pulley guides the fiber between the wire strands or wire guides onto an outer surface of a fiber coil being formed on the spool.

In yet another embodiment of the fiber guide, the wire strands are electrically insulated from the automatic coil winding machine. In addition, the automatic winding machine provides a means for electrically sensing and teaching the servo means where the limits of linear travel exist for the wire strands parallel to the rotation axis of the spool rotation axis. The limits exist where the outer surface of wire strands electrically contacts a corresponding left or right flange inner surface. A tool is shown for transferring the location and position between a spaced apart pair of non-conductive inner flange surfaces to an external space bordered by conductive surfaces to teach a linear servo where the limits of travel should be set.

DETAILED DESCRIPTION OF THE PREFERRED EMBODIMENT

Figure 1:
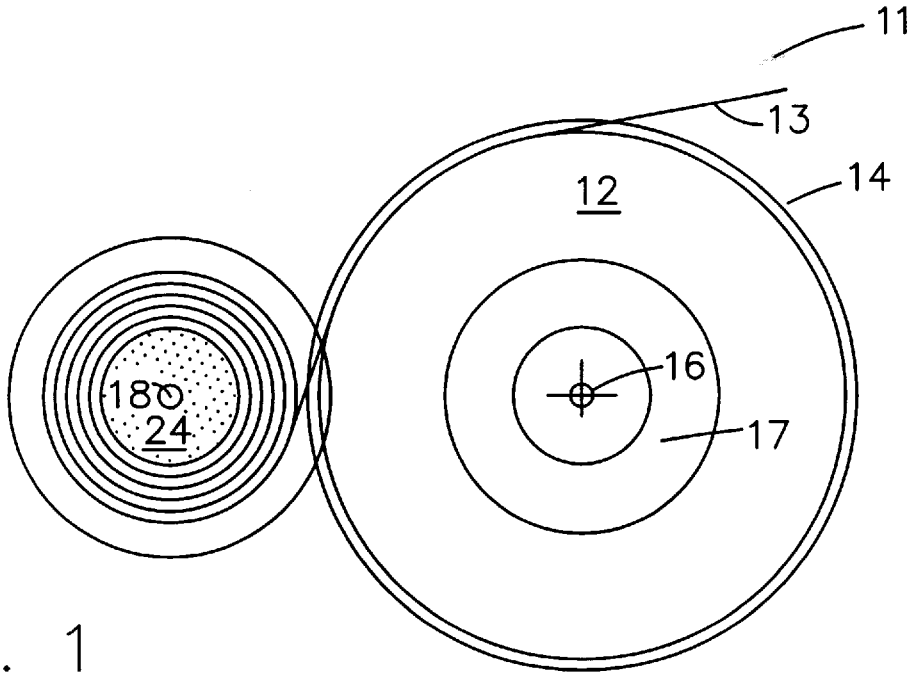
FIG. 1 PRIOR ART
FIGS. 1 and 2 are side elevational and top plan views of prior art pizza cutter type fiber guides.
Figure 2:
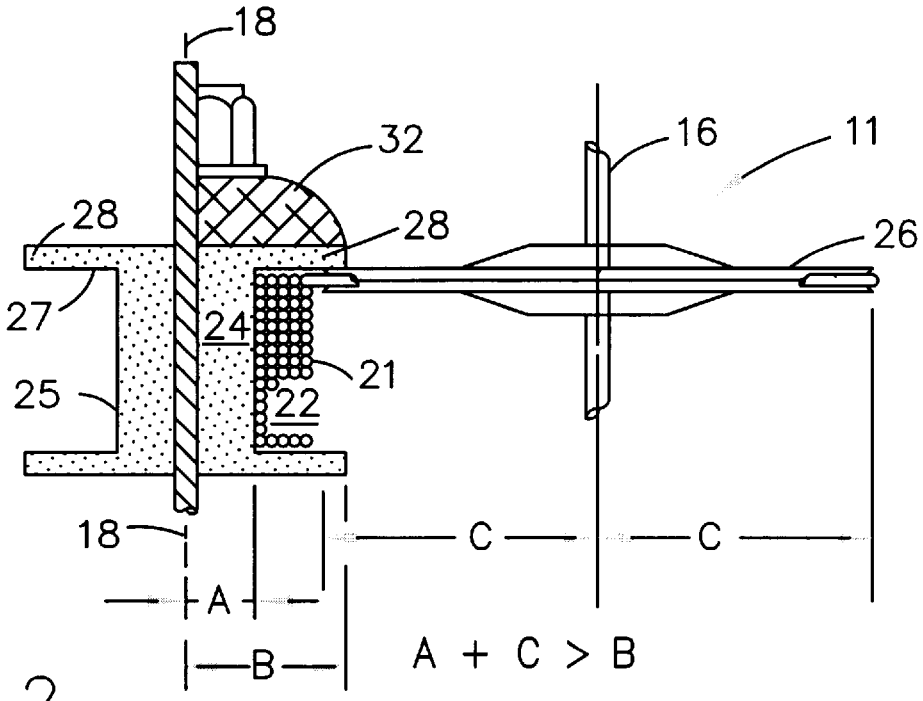
FIG. 2 PRIOR ART

FIGS. 1 and 2 show an earlier pizza cutter style fiber guide 11 with its guide wheel 12 portrayed as thin as possible. Optical fiber 13 is carried in the grooved circumferential outer edge 14 of the guide wheel 12. The guide wheel 12 rotates on its guide wheel shaft 16.

In operation, the guide wheel 12 is mounted on a coil winding machine (not shown) and is translated by a linear servo motor drive (not shown) parallel to the rotational axis 18 of spool or coil form 20. The guide wheel 12 feeds fiber onto the rotating outer layer or outer surface 21 of the fiber coil 22 that is being formed on the rotating spindle 24 of the spool or coil form 20. The space on a plane passing through the axis of the coil form or bobbin 20 and bordered by the spindle surface 25 of the spindle 24 and the inner walls 27 of spool flange 28 forms a winding window.

FIG. 2 schematically shows the fiber guide 11 driven by linear servo motor drive (not shown) moved to the right or upward in the figure until the top surface 26 of the guide wheel 12 deposits the last fiber coil on the outer or top layer 21 of the fiber coil 22 and contacts the right spool flange 28 inner surface 27. As shown in FIG. 1, fiber guide 11 is translated in and out of the page, as the spool 20 rotates on its axis 18.

As shown in FIGS. 1 and 2, the minimum size of the guide wheel radius C is determined by radii A (of the spindle 24) and flange radius B, of the spool or coil form 20. The guide wheel shaft 16 must always be located outside the spool's flange radius "B". From FIG. 2, it can be seen that the sum of the guide wheel radius C and the spindle radius A must be greater than the radius of the spool flange B or (C+A>B).

Figure 3:
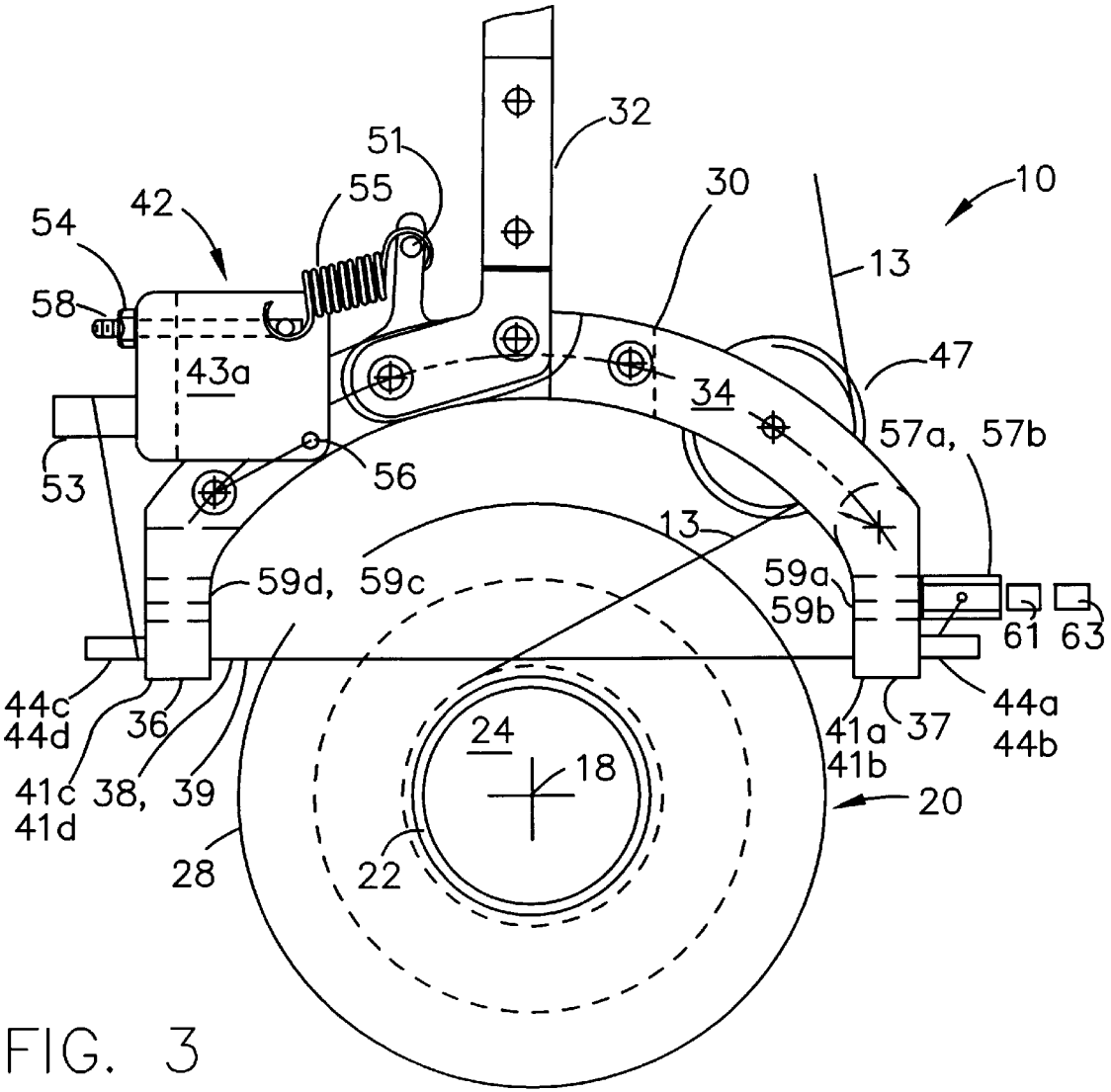
FIG. 3 is an elevational view of the present invention fiber guide.
Figure 4:
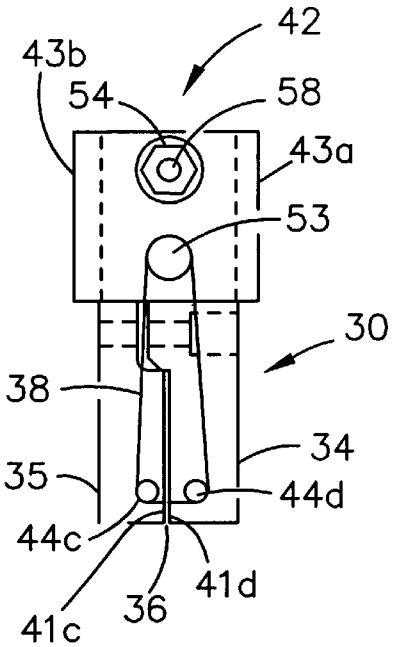
FIG. 4 is an end view of FIG. 3 showing a toggle plate tensioner.

FIGS. 3 and 4 show a first embodiment of the present invention fiber guide 10 comprising a rigid body having a pay guide assembly 30 and pivot arm 32. The pay guide assembly 30 is an arcuate body with an arcuate opening. The arcuate body has two parts or similar sections, i.e. a left and right pay guide hand 34, 35 with a gap or throat between the parts at their respective left and right ends. The location of a left or bottom throat 36 is indicated at the left of FIG. 3 and a right or top throat 37 is indicated at the right. The bottom throat 36 is also shown in FIG. 4. Each throat has a respective first and second side separated by a predetermined distance.

In the first embodiment of FIGS. 3 and 4, two parallel wire strands of music wire, a left and right parallel strand or guide 38, 39 are tightly stretched across the arcuate opening or cord of pay guide assembly 30 and are anchored at one end (the right end). The parallel strands or guides extend from pin 53 on tensioner 42 at the other end (the left end).

A length of music wire is first draped over the large dowel pin 53 and then wrapped around dowel pins 44*d*, 44*c* to pass through the bottom throat 36 at the left of the pay guide assembly 30. The wires then pass across the arcuate opening or cord to and through the top throat 37 at the right of pay guide assembly 30. The left or lower end and the right or upper end of each pay guide hand each have a pair of respective opposing registration faces spaced apart to form a thin gap or throat. FIG. 4 shows the lower opposing registration faces 41*c*, 41*d* forming the bottom throat 36. The top throat 37 (not shown in FIG. 4) is formed by opposing registration faces 41*a*, 41*b*. The pay guide hands are held together and dimensioned to create the slight gap, e.g. 0.016 inches, between lower and upper pairs of opposing registration faces 41*c*, 41*d* and 41*a*, 41*b* respectively. Each wire strand passing through the lower or upper throat 36, 37 is therefore in contact with a corresponding pay guide hand lower and upper opposing registration face 41*d*, 41*a* and 41*c*, 41*b*. Reference numbers 36, 37, 41*a*, 41*b*, 41*c* and 41*d* shown in FIG. 3 are positioned to indicate proximate location only.

Wire tensioner 42 pivots in response to the tension in spring 55, in a clockwise direction around pivot pin 56 to maintain tension in wire strands 38, 39 by urging pivotal plate or block 43 to raise the large pin 53 thus tensioning the wire strand around dowel pin 44.

Spring 55 is fixed to pay guide assembly 30 by pin 51 and extends between parallel plates 43*a*, 43*b* of tensioner 42 to engage tension adjusting screw 58 to force the plates 43*a*, 43*b* to the right, thereby maintaining the left and right parallel strands or guides 38, 39 taut. Tension is adjusted as required by rotating a nut 54 shown on the left end of adjusting screw 58.

FIG. 3 shows that the other ends of the left and right parallel strands are each anchored to the pay guide assembly 30 by hollow threaded standoffs 57*a* and 57*b*. In FIG. 3, hollow threaded standoff 57*b* is hidden behind hollow threaded standoff 57*a*. Each hollow threaded standoff is screwed into a corresponding cross-drilled hole at 59*a*, 59*b* with the wire strands penetrating the hollow threaded standoffs 57*a*, 57*b* and being wrapped around the respective dowel pin 44*a*, 44*b*. Cross-drilled hole 59*b* and dowel pin 44*b* are also hidden behind their respective 59*a*, 44*a* counterparts. The left and right parallel strand or guides 38, 39 are wrapped around a respective dowel pin 44*a*, 44*b* and then penetrate the respective hollow threaded standoff bodies 46*a*, 46*b*. Cross drilled holes 59*d* and 59*c* are not used but are available for use by standoffs as an alternative to tensioner 42.

Figure 9:
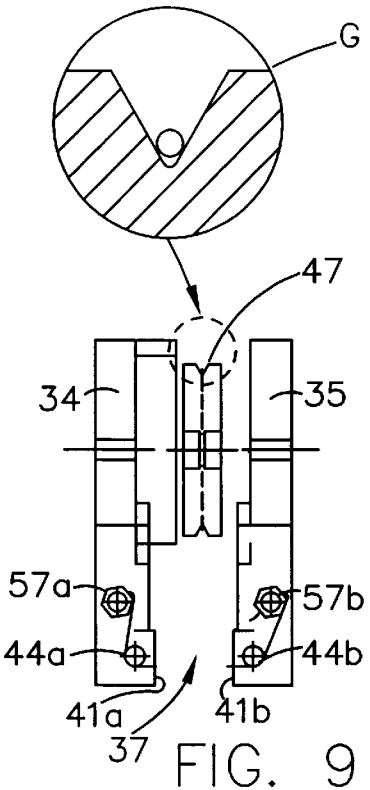
FIG. 9 is an exploded top elevation view of the left and right pay guide arms and the guide wheel.
Figure 8:
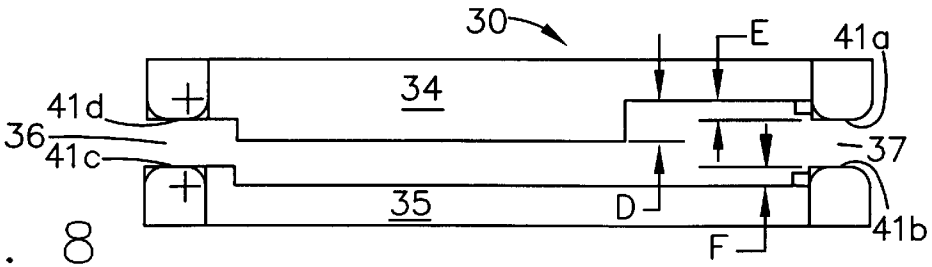
FIG. 8 shows a top elevation view of the left and right pay guide arms, the guide wheel being omitted.
Figure 10:
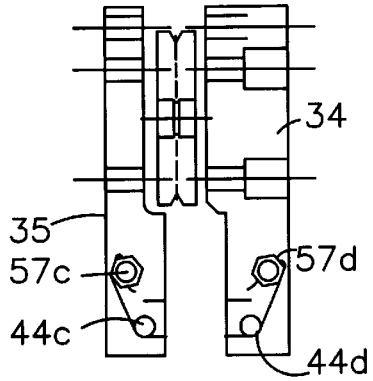
FIG. 10 is an exploded bottom elevation view of the left and right pay guide arms and the guide wheel.

FIGS. 8–10 show an alternative embodiment in which each end of the left and right pay guide arms 34, 35 is drilled to provide a corresponding cross-drilled hole which is then threaded to receive the external threaded end of a hollow threaded standoff (not shown). Two hollow threaded standoffs 57*a*, 57*b* are used in the embodiment of FIG. 3 which uses a tensioner 42. Four standoffs are used in the embodiment of FIGS. 8–10 in which the tensioner 42 is omitted.

Referring again to FIG. 3, a pair of aluminum dowel pins 44*a*, 44*b* and a pair of hollow threaded standoffs 57*a*, 57*b*, the second in each pair being hidden by the first, are similarly disposed at the right end of the pay guide arm. The standoffs serve to anchor the respective wire strands as tension is adjusted by rotating the hollow threaded standoff bodies 46*a*, 46*b* of the hollow threaded standoffs 57*a*, 57*b* or by other preferable alternative means.

The pay guide assembly 30 has an open receiving aperture to receive spool or coil form flange 28. Glass or fiber optical fiber 13 bends around a 1 inch guide pulley 47 carried by the arcuate body or pay guide assembly 30 for guiding the fiber between parallel spaced apart wire strands or wire guides 38, 39 onto the spool 20 which guide it very closely to the last layer of fiber laid down on fiber optic coil 22. The parallel wire strands or guides 38, 39 are formed from piano or music wire or other filament having high tensile strength such as glass fiber or steel wire.

The guide pulley 47 is carried by the pay guide assembly 30 for guiding the fiber between the wire strands 38, 39 and onto the spool 20 or more particularly onto the rotating outer surface 21 of the fiber coil 22.

Spool 20 is turned on axis 18 (FIG. 3) to draw the fiber 13 onto the fiber coil 22. Pivot arm 32 may be pivoted to maintain the proximity of optical fiber 13, wire strands 38, 39 and the rotating outer surface 21 of fiber coil 22 on spool receiving optical fiber 13.

Figure 5:
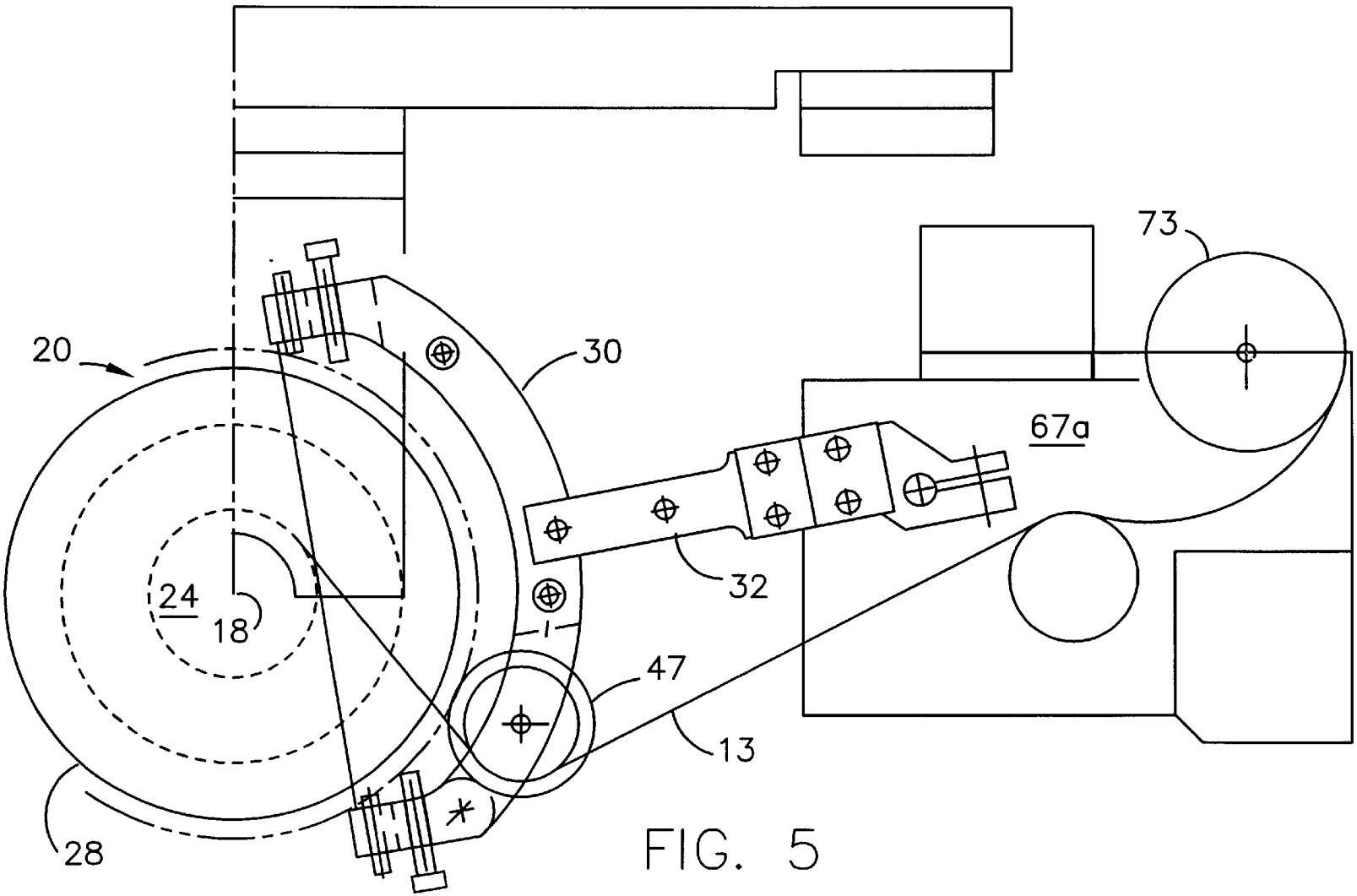
FIG. 5 shows the new fiber guide pivotally mounted from an automatic winding machine.

FIG. 5 shows the pay guide assembly 30 mounted offset from the automatic machine 67*a* by pivot arm 32. The preferred layout of the pivot arm 32 is 10 degrees below the horizon, (in the figure) the ends of the pay guide assembly 30 are on a phantom circle having a diameter of 3.93 inches (just slightly larger than the O.D. of the spool flange 28). Optical fiber 11. is shown leaving a fiber source spool 73 or half transfer spool, passing under the guide pulley 47 and between the wire strands 38, 39. The wire strands are depicted as almost touching the outer layer 21 of coil 22.

Figure 6:
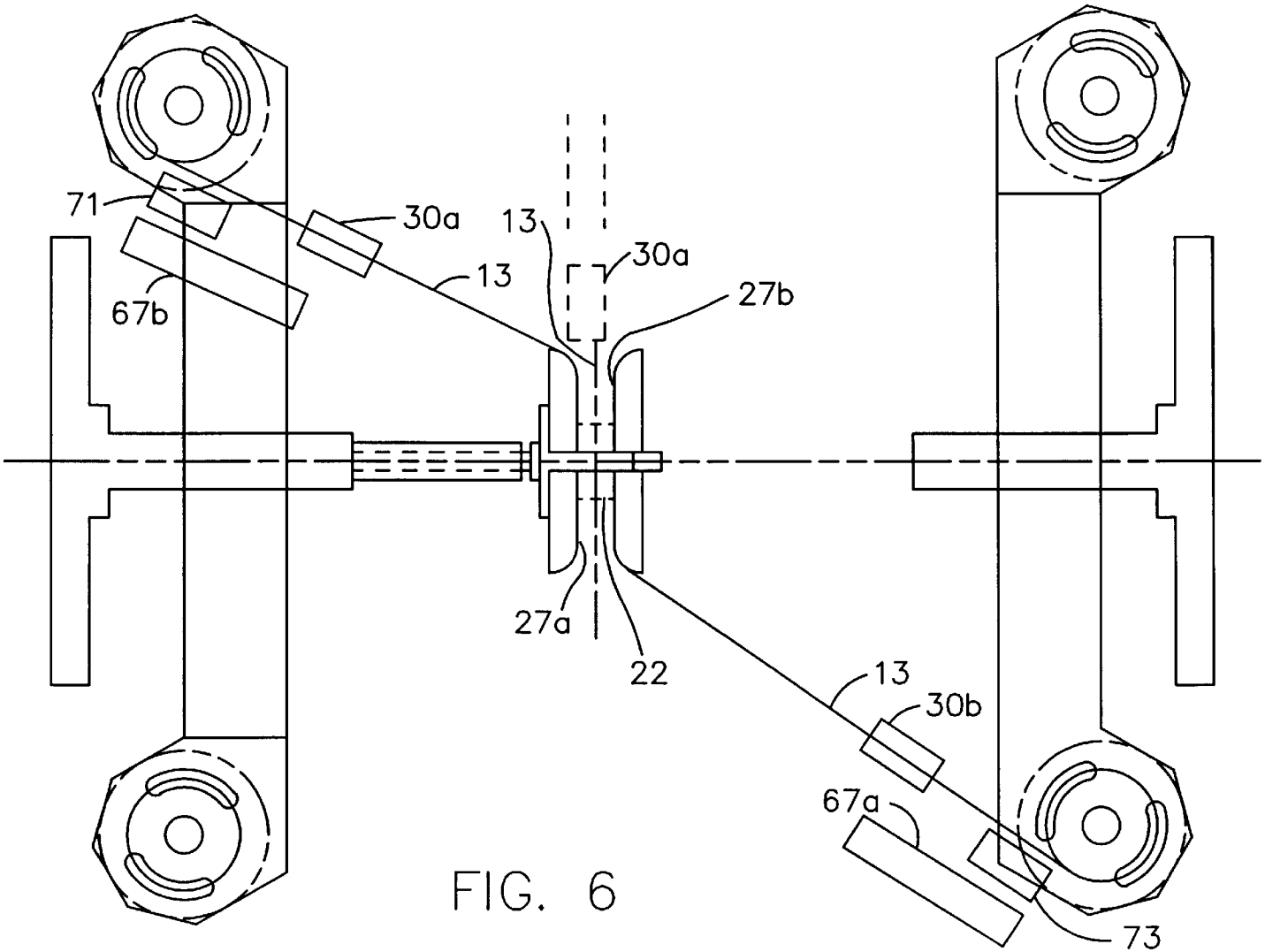
FIG. 6 illustrates quadrupole winding employing the subject new fiber guide.

FIG. 6 is a schematic layout to show how quadrupole winding is accomplished by the present invention with two fiber guides each being supplied with fiber from a respective half transfer spool 71,73. The fiber guide 30*b* at the lower right is in its stored position. The fiber guide 30*a* at the upper left is also in a stored position; however, the same fiber guide is depicted in phantom as 30*a* in its registered position above fiber coil 22. The use of two fiber guides permits alternated ends of the fiber to be controlled and fed in alternated layers between the spool flanges 27*a*, 27*b*.

U.S. Pat. Nos. 4,856,900 to Ivancevic, 5,371,593 to Cordova et al and 5,405,485 to Henderson, all incorporated herein by reference, explain the details of quadrupole winding and how an automatic winding machine is made and operates to make coils for fiber optic rotation sensors.

FIG. 6 shows the automatic machines 67*a* and 67*b* represented as blocks. The two half transfer spool sources of fiber 71 & 73 are also represented as blocks, and are used to alternately lay down layers of fiber between the spool flange's inner surfaces 27*a*, 27*b* on fiber coil 22

Figure 7:
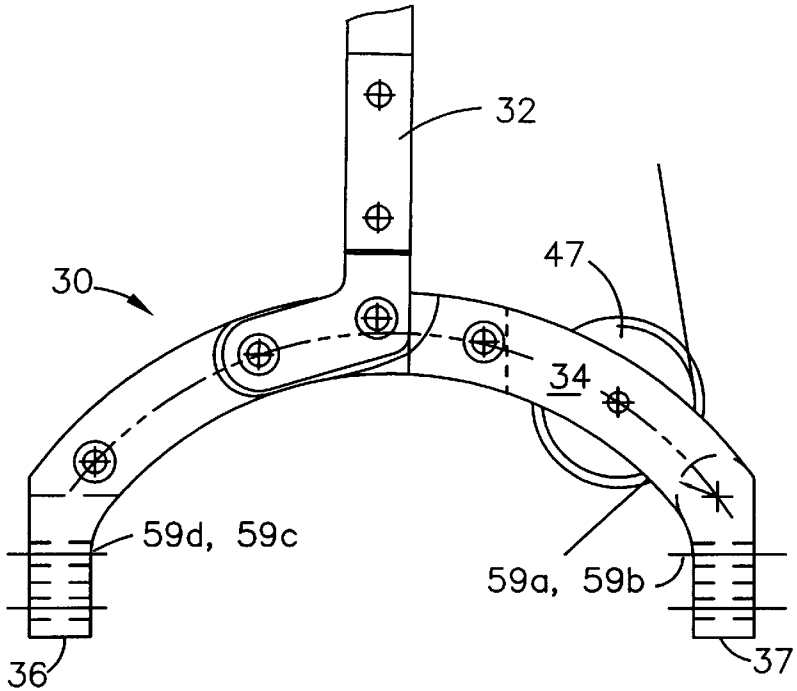
FIG. 7 shows the pay guide assembly with guide wheel guiding optical fiber.

FIG. 7 is a schematic plan view showing the pay guide assembly 30 with pivot arm 32 attached. The guide pulley 47 is supported by a shaft and bearing means and is depicted as guiding optical fiber 13. A pivotal connection (not shown) from the winding machine holds the pay guide assembly in proper position and orients the pay guide. As shown in FIG. 5, a declination angle of 10 degrees from level leading to the coil spindle has been found to be best for operation.

FIG. 8 is an exploded forward view of the pay guide arm showing a left and right pay guide arms 34, 35 that comprise the pay guide. As the hands are joined, in the central region, it can be seen that a hole or recess for receiving the guide pulley 47 is provided. The throat gap for the left and right throat can be seen to be approximately equal to dimension G where G=D−(E+F)

FIG. 9 is an exploded plan view of the top view of the left and right pay guide arms and the guide pulley 47. The insert phantom circle figure is a schematic depicting the optical fiber 13 residing in a circumferential groove in the guide pulley 47. Left and right dowel pins 44 and left and right standoffs are also shown with the wire strands wound thereon and passing down into the top throat.

FIG. 10 is an exploded plan view of the bottom view of the left and right pay guide arms and the guide pulley which would be obscured if the left and right hands are brought together. Use of the standoffs shown will depend on the tensioning means selected.

Figure 11:
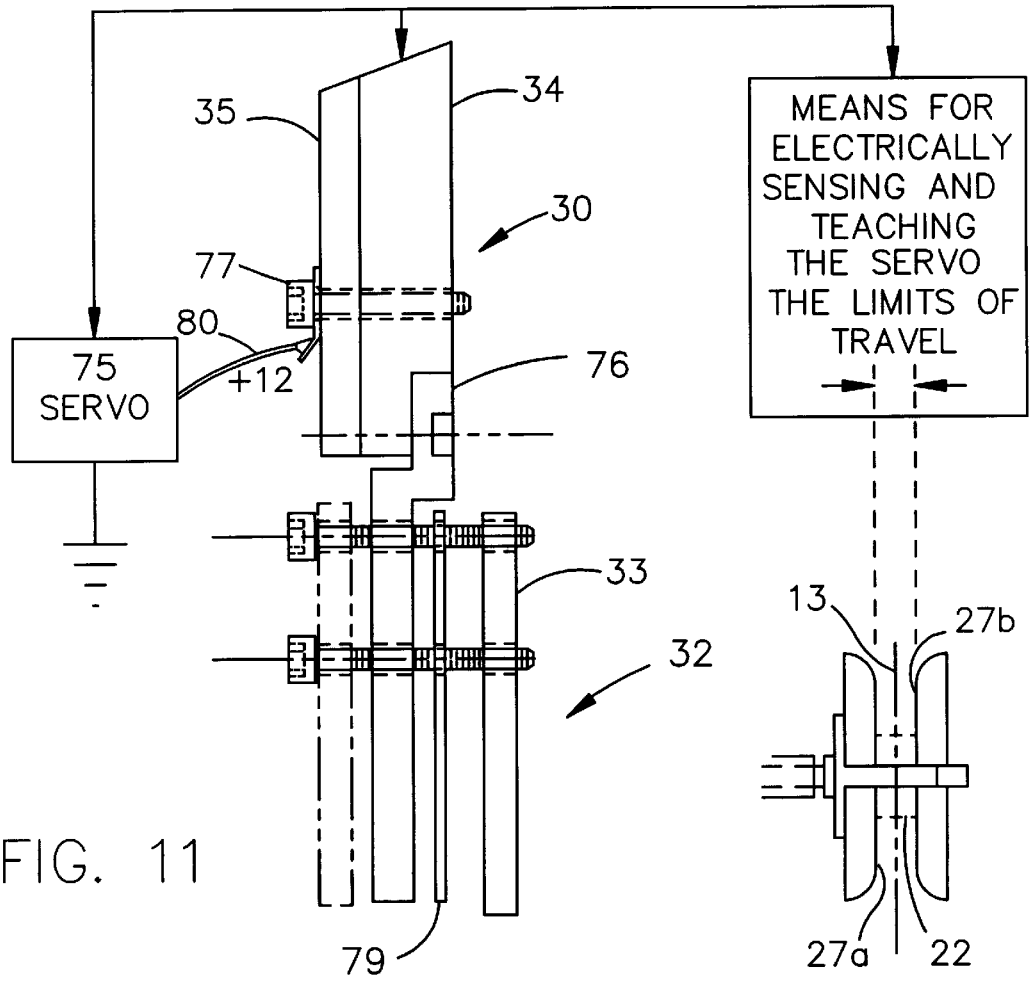
FIG. 11 is an exploded top plan view showing the pay guide assembly attached to the guide arm, the guide arm being insulated from the pay guide assembly by a kapton insulator.

FIG. 11 is a top plan view of the pay guide assembly 30 with the left and right pay guide arms 34, 35 clamped together by a contact bolt 77. The contact bolt also electrically connects a signal source via a terminal and conductor 80 to the right pay guide arm 35.

The pivot arm 32 is shown as an exploded assembly comprising a pivot arm adaptor 76 coupled to the left pay guide arm 34 and a pivot arm extension 32 coupled to the pivot arm adapter 76 and to the winding machine (not shown). An insulator, such as a kapton insulator 79 is interposed between the pivot arm extension 32 and the pivot arm adaptor 76 for insulating the pay guide assembly 30 from the pivot arm extension 32. Non-conductive screws couple the pivot arm adapter to the pivot arm extension 32. A phantom pivot arm extension is shown at the left of the pivot arm.

In this arrangement, wire strands 38, 39 (not shown) are electrically insulated from the automatic coil winding machine. The position of the pivot arm extension relative to the adapter would be switched to the phantom position for use in a the second fiber guide on an automatic winding machine.

Figure 16:
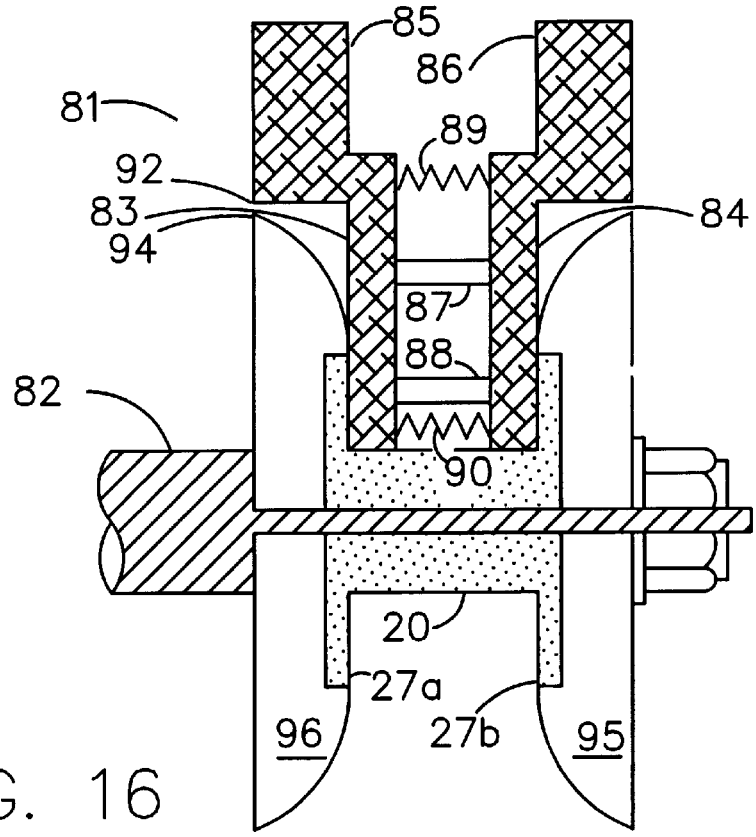
FIG. 16 is a schematic sectional view of a tool used to provide a conductive surface that is co-planar with a spool's non-conductive left and right inner flange surfaces.

The use of the Kapton insulator and an electrical signal source represents a means for electrically sensing and teaching the servo means (not shown) the limits of travel parallel to the rotation axis 18 of the spool rotation axis necessary to bring each respective strand to a corresponding left and right spool flange surfaces 27*a*, 27*b* as shown in FIG. 6 and FIG. 16.

When a bobbin is used having conductive flanges, the contact of the electrically excited music wire with the flange produces an electrical response that is detected by an a sensor that signals the location of the linear motor servo into a memory for storage. The electrical contact surface on the inner wall of the bobbin is in fixed relation with the winding machine frame.

The detected signal is used to signal the lateral drive servo and computer control moving the fiber guide to stop or reverse its direction each time the guide reaches the end of a layer of fiber coils. The encoder readout for the position of the guide at the point of electrical contact is stored and thenceforth used as the learned drive limit for lateral movement of the fiber guide carried by the servo drive assembly on the winding machine.

Figure 12:
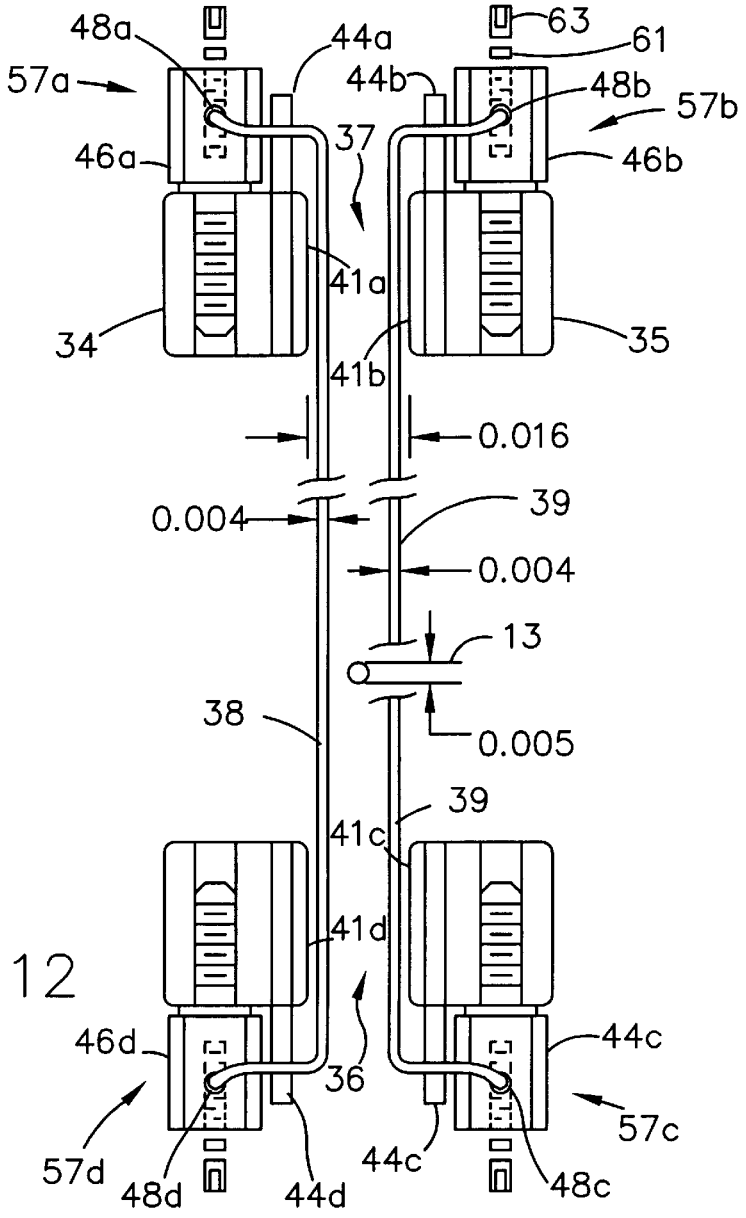
FIG. 12 is a schematic end view of the music wires with a fiber passing between them, the music wires being moored by hollow threaded standoffs at both top and bottom of the right and left guide arms.

FIG. 12 is a schematic end view of the wire strands, the top and bottom throats, and the fiber 13 passing between the wire strands. Hollow threaded standoffs 57*a*, 57*b*, 57*c* and 57*d* are shown along with dowel pins 44*a*, 44*b*, 44*c* and 44*d* at the top and bottom pay guide arms 34, 35. The wire strands 38, 39 are shown retained and tensioned by the standoffs 57*a*, 57*b*, 57*c* and 57*d* as the wire strands pass across opposing registration faces 41*a*, 41*b* and 41*d*, 41*c* respectively. The fiber 13 is shown passing around the dowel pins 44 and entering the receiving hole in each of the the hollow threaded standoff bodies 46*a*, 46*b*, 46*c* and 46*d*. This figure shows the spaced apart left and right parallel strand or guide wires 38, 39 guiding the glass or optical fiber 13 therebetween. The diameter of the wire may be 0.004 inches and the spacing between the wires 0.008 inches. The glass fiber, in this example, has a diameter that is typically in the range of 0.0031 inches to 0.0049 inches.

WIRE CONTROLLED FIBER GUIDE WIRE INSTALLATION PROCEDURE

Figure 13:
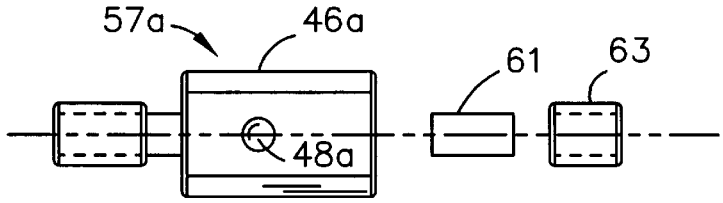
FIG. 13 is an exploded side elevation of the hollow threaded standoff body, the o-ring or rubber plug insert and the set screw.

FIG. 12 is a schematic view of the ends of the left and right pay guide arms. The steps for installing the music wire or left and right parallel strand or guides 38, 39 into the fiber guide and adjusting the tension proceeds as follows:

1. Install the hex standoffs 57*a*, 57*b*, 57*c* and 57*d* into the tapped holes of the left and right pay guide arms. Torque until standoffs 57*a*, 57*b*, 57*c* and 57*d* make light contact with Fiber Guide body. Wire Installation, "Bottom End."
2. Using 0.004" diameter music wire, cut off an approximate 12 inch length.
3. Referring to FIGS. 12 and 13, thread one end of wire through a cross-drilled "hole 48*d*, 48*c* in a hexagonal hollow standoff body 46*d*, 46*c*".
4. Install the o-ring segment into the threaded hole of the standoff 46. "hole 48*d*, 48*c* in a hexagonal hollow standoff body 46*d*, 46*c*".
5. Install the set-screw into the same threaded hole following the o-ring segment. Torque the set-screw sufficiently such that the wire is restrained in the hole. Apply 1 to 3 full wraps of wire around standoff 57*d*, 57*c* prior to routing around a corresponding 0.125" die dowel pin 44*d*, 44*c*. *Wire Installation, "Top End"*.
6. Route wire around 0.125" die dowel pin 44*a followed by* 1 to 3 full wraps (CCW) around standoff 57*a*. Next, thread the end of the wire through the cross-drilled hole 48*a* in the hexagonal hollow standoff 46*a* for the lower end of the pay guide arm.
7. Install o-ring segment and set-screw per steps 4 and 5.
8. Lightly tension the wire by rotating the standoff.
9. Using a dowel, gently push both wires in and out, at each end of Fiber Guide, attempting to make them parallel when viewed from the side of the Fiber Guide. From this view, only one wire should be visible.
10. Repeat steps 2 through 8 using the other length of wire.

Final Tension Adjustment:

11. Using a gram force gage at the wire mid-span, check the lateral deflection force of each wire for a deflection of 0.004" at mid-span. Note that 0.004" can be estimated when wires are viewed under a microscope: 0.004"=1 wire diameter.
12. Adjust the "Top End" standoff (item 1) to obtain 3.0 to 4.0 grams deflection force for 004" lateral deflection.
13. Check wire separation gap at both ends of Fiber Guide. Verify that gaps are within 0.0075" to 0.0085". If necessary, fiber guide mating surfaces can be shimmed to achieve the correct spacing.

FIG. 13 shows a disassembled hollow threaded standoffs 57*a* having a threaded hollow standoff body 46*a*, a transverse receiving hole 48*a* drilled therein to receive an end of the left parallel strand or guide 38. The threaded hollow standoff body 46*a* in combination with rubber plug 61 and screw 63 form a means for anchoring the left and right parallel strands to the pay guide assembly or pay guide arms 34, 35. As discussed later in connection with FIG. 14 and 18–23, an alternative means for anchoring the left and right parallel strands is provided by a washer fixed between the wires by a screw or bolt or adhesive to fix the spacing of the wires to a predetermined width.

A left or right parallel strand 38, 39 is anchored by threading each of them through a corresponding cross drilled hole 48*a* and locking each of them in place with a rubber plug 61 as each rubber plug is driven into the axial hole by the #9–32 screw 63. Once the music wire, extending through the cross drilled hole, is locked in place by the rubber plug, the tension of the music wire is adjusted by turning the standoff.

Figure 14:
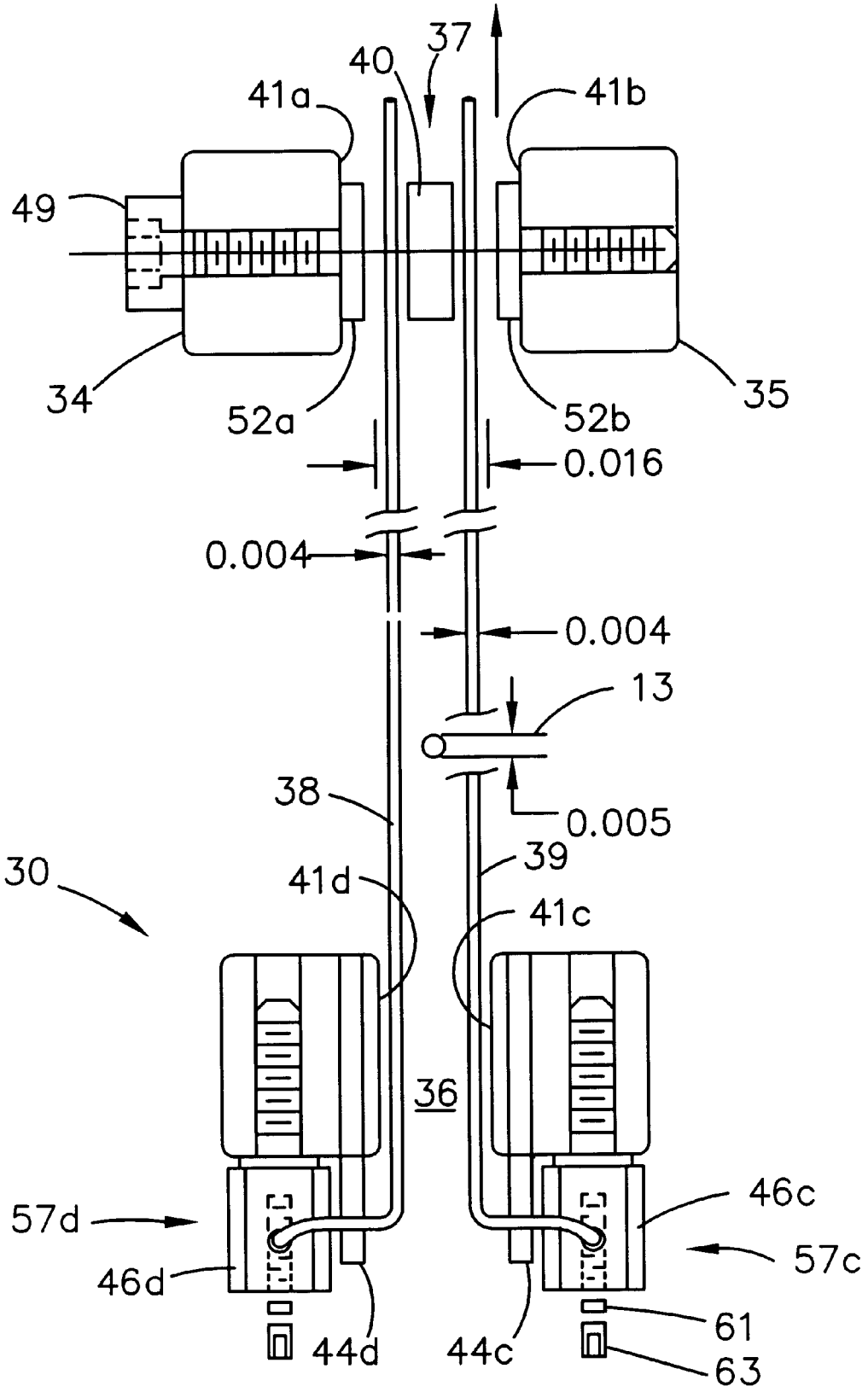
FIG. 14 is a schematic end view of the music wires with a fiber passing between them, the music wires being moored by hollow threaded standoffs at the bottom end and clamping between a separator washer against outer washer surfaces between the upper registration surfaces of the left and right pay guide arms.

FIG. 14 is a schematic end view the left and right pay guide arms 34, 35 with the left and right parallel wire stands 38, 39 passing therebetween. Only the bottom throat 36 is shown open in the embodiment of FIG. 14. The top throat 37 is blocked by a bolt 49 that is used to clamp the pay guide arms 34, 35 together with the left and right parallel strands 38, 39 held or clamped therebetween, and separated by a spacer washer 40. The thickness of spacer washer 40 sets the separation of the left and right parallel strands 38, 39. Spacers or shims or washers 52*a*, 52*b* protect the opposing registration faces 41*a*, 41*b* of the pay guide arms 34, 35. It should be understood that alternative methods of clamping the pay guide arms 34, 35 might be used, such as, an external clip or a welded bridge to join the left and right pay guide arms 34, 35.

The other ends of the left and right parallel strands 38, 39 are each shown anchored to the pay guide assembly 30 by hollow threaded standoffs 57*d*, 57*c* screwed into body 30, with ends of the right and left parallel strands 38, 39 penetrating the hollow threaded standoff bodies 46*d*, 46*c* after being wrapped around the dowel pins 44*d*, 44*c*. Four hollow threaded standoffs are shown used in the embodiment of FIG. 12 while the embodiment of FIG. 14 requires only two hollow threaded standoffs.

The use of spacer 40 results in closing the top throat 37 or the bottom throat 36 at the end of the receiving aperture at which it is used. Spacer washers 40 may be used at both ends of the receiving aperture or in both throats for applications not requiring that the fiber be wound from the midpoint of a single strand. Such applications include fiber optic mandrels which are wound from the starting end of a fiber and not from the middle.

The tension in the left and right parallel strands 38, 39 is adjusted by anchoring the left and right parallel strands 38, 39 and then orientating the pay guide assembly 30 such that the left and right parallel strands 38, 39 point downward. A predetermined weight characterized to provide a proper level of tension or preload is then coupled to each of the wire strands 38, 39 as the bolt is tightened clamping the wire strands on opposing sides of the spacer washer 40 to prevent relaxation of the tension and strain in the wire strands.

The combination of the pay guide arms and the clamping action of the bolt 49, the spacer washer 40 and the anchor provides by the hollow threaded standoffs thereby form a wire tensioning means. Another alternative wire tensioning means might use a large pin (not shown) such as pin 53 shown in FIG. 4 as an alternative to the two hollow threaded standoffs on the pay guide assembly 30. The procedure would proceed with the step of draping the wire strand that will form the left and right parallel wire strand 38, 39 over the large pin 53, orientating the pay guide assembly 30 such that the left and right parallel strands 38, 39 point downward. A single weight is then coupled to both ends of the wire strand exiting the second throat which insures an equal level of tension in each of the left and right parallel wire strands 38, 39 as the bolt 49 is tightened clamping the wire strands 38, 39 to opposing sides of the spacer washer 40 thereby preventing relaxation of the tension and strain in the left and right parallel wire strands 38, 39.

In yet another alternative tensioning means, a bolt and spacer washer such as bolt 49 and spacer washer 40 could be used at the throat of each end of the pay guide assembly 30 as an anchor or mooring means. One end of the guide would be clamped thus securing the wire strands 38, 39 spaced by spacer washer 40 in a first throat.

The same procedure as characterized above would then be used to space and clamp the wire strands as they exit the second throat concurrent with being pre-loaded to obtain the proper tension. This procedure eliminates the need for the large pin 53 and all hollow threaded standoffs but requires the use of a separate weight simultaneously applied to each of the wire strands exiting the second throat. Both throats are blocked in this arrangement.

The embodiments of FIG. 14 that have been characterized retains the notion of using left and right parallel strands 38, 39 as parallel guides but eliminates hollow threaded standoffs 57*a*, 57*b* along with dowel pins such as 44*a*, 44*b* at least at the top of the pay guide arms 30.

Previous fiber guides, such as those in FIGS. 3, 4, and 7–10 are more complicated and difficult to setup than the embodiments using the spacer washer 40 of FIG. 14. The tension was set by deflection of the wire after tensioning and required multiple trial and error steps to achieve the desired tension. The spacing between the wires was established by two parallel left and right pay guide arms which are permanently spaced and which could only be changed by complete tear-down and the addition of shims or machining. Standoffs had to be adjusted with each tear-down.

FIG. 14 shows the left and right parallel strands 38, 39, or spaced apart piano wires 38, 39 guiding the glass or optical fiber 13 therebetween. As in the discussion of FIG. 12, the diameter of the wire may be 0.004 inches and the spacing between the wires 0.008 inches. The glass fiber, in this example, has a diameter that is typically in the range of 0.0031 inches to 0.0049 inches. Additional alternative views and embodiments for the pay guide assembly 30 are presented in FIGS. 18–24.

Figure 15:
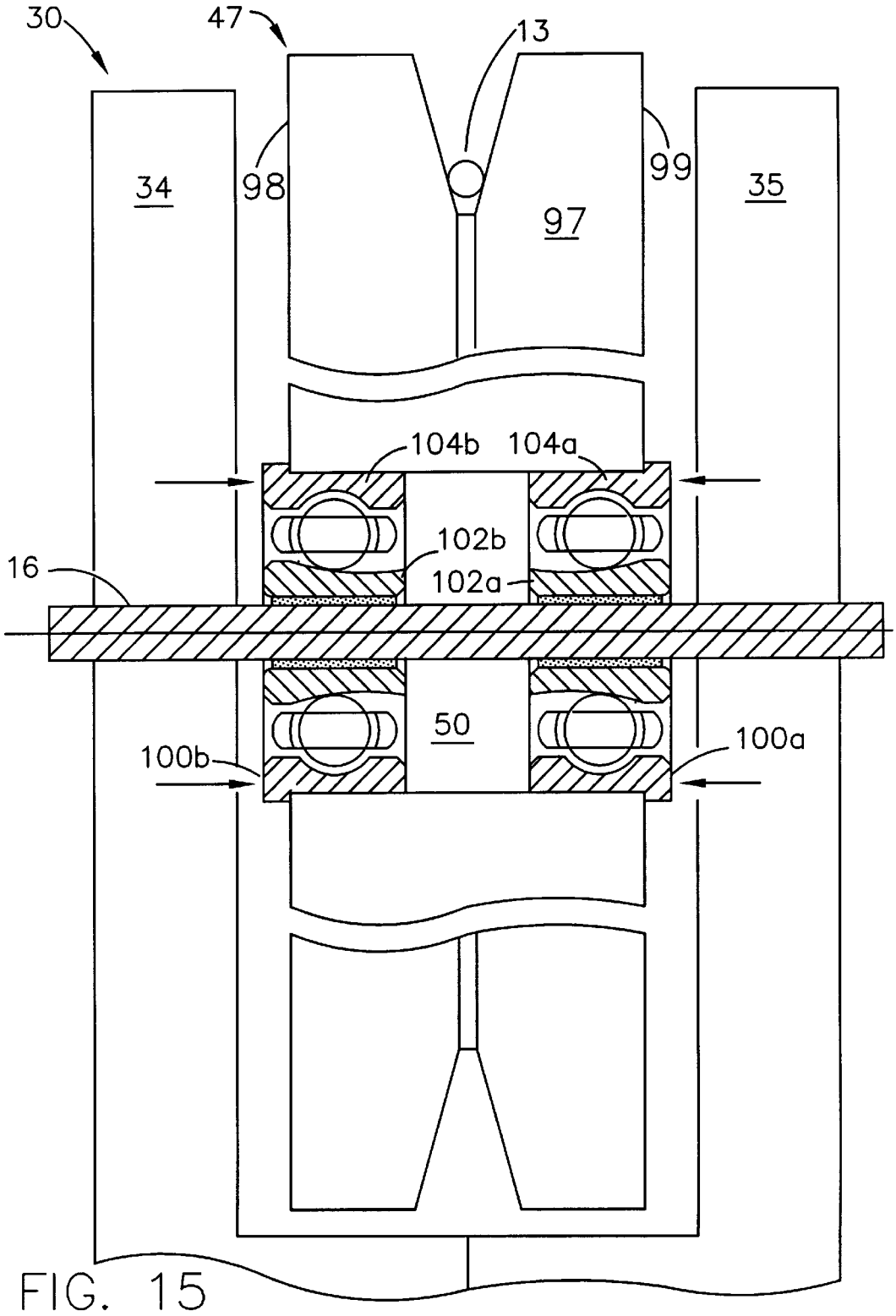
FIG. 15 is a schematic partial section of the guide wheel supported by a shaft between the left and right pay guide arms.

FIG. 15 is a partial section schematic view of the guide pulley 47 having guide pulley wheel 97 a left and right face 98, 99 and an axle hole 50. The guide pulley 47 is carried by the pay guide assembly 30 to guide the glass fiber 13 to and between the left and right parallel strands 38, 39 of music wire for deposit onto the coil on spool 20. The guide pulley wheel 97 is mounted on guide wheel shaft 16 using a right and a left ball bearing 100*a*, 100*b*. Each respective bearing has an inner 102*a*, 102*b* race and outer race 104*a*, 104*b*. Each respective race has a respective inner and outer surface.

Prior to mounting the bearings, the dimensions of the guide pulley wheel 97, pay guide arms, and the guide pulley's 98, 99 and the length of shaft 16 are analyzed and the shaft 16 is marked to permit precise location of the outer surface of the inner race of the right bearing at a predetermined distance from the end of the shaft 16. The shaft length, the pay guide wall thicknesses, the wheel thicknesses and bearing shoulder thickness are analyzed and characterized to position the center of the wheel on a line to pass the optical fiber precisely between the left and right parallel strands 38, 39.

The right bearing 100*a* is then positioned on the shaft and moved to align the outer surface of the inner race with the mark. Once positioned, the right bearing's inner race 102*a* is secured with a cyanoacrylic adhesive (crazy glue). The shaft is then inserted into a receiving hole through the right pay guide arm 35 and pressed in until the end of the shaft 16 is flush with the outer surface of the right pay guide.

The mark is positioned on the shaft at a location from the shaft's end, based on the analysis, to locate the bearing so that a predetermined clearance would exist between the inner surface of the right pay guide arm and the outer surface of the outer race of the right bearing 100*a*.

The guide pulley 47 is then positioned onto the right bearing. The left bearing is then positioned onto the shaft with its outer race 104*b* inserted into the axle. A force is then applied to the inner race 102*b* of the left bearing 100*b* as the wheel is spun and released. The force is adjusted to the point at which the guide pulley wheel 97 rotates wobble free and for which a very slight deceleration in the guide pulley wheel 97 is perceived. At that point, the bearing 100*b* is secured on the shaft, with the same force applied, with cyanoacrylic adhesive. A small amount of cyanoacrylic adhesive is also applied to the joint between the left surface of the wheel and the shoulder of the outer race of the left bearing 100*b*.

FIG. 16 shows a schematic sectional view of a coil form 20 mounted on a mandrel 82 prior to use for winding a coil. If the coil form 20 is of non-conductive material, the inner walls of the spool flange inner surfaces or coil form flanges 27*a*, 27*b* shown in FIGS. 6 and 17 can not be used for electrically signaling when the wire strands reach the limit of lateral travel. A tool 81 is shown draped over the coil form. Lower left and right registration walls 83, 84 are co-planar with the upper inner registration walls 85, 86. The tool is typically of aluminum. Upper and lower guide pins 87, 88 allow the left and right halves to extend and contract with near perfect orthogonality.

Top and bottom springs 89, 90 restore the halves to engage and retain contact with the inner walls of the flanges. The left and right upper inner registration walls 85, 86 are conductive and co-planar with the inner walls of the flange. The inner registration walls 85, 86 are electrically contacted by the left and right parallel strands 38, 39 to signal the servo 75 and teach the servo where the limits of travel are in relation to the inner walls of the spool flange inner surfaces 27*a*, 27*b*.

Figure 17:
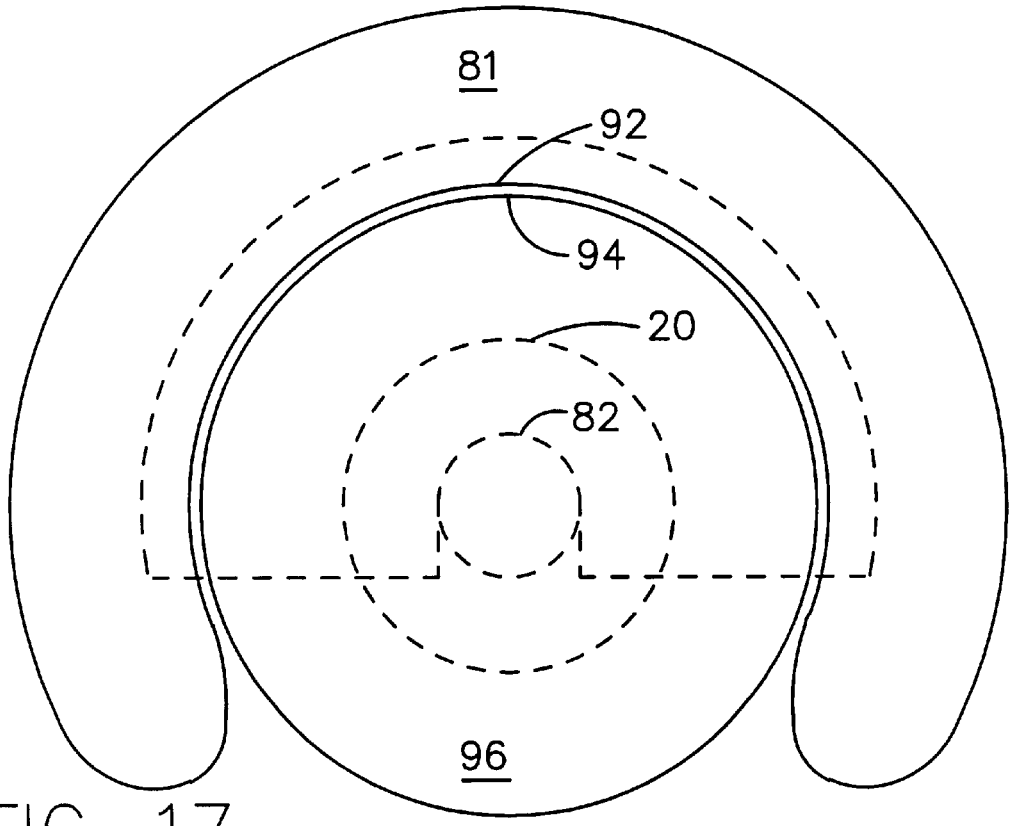
FIG. 17 is schematic end view of the tool of FIG. 16 draped over the spindle of a non-conductive spool or bobbin.

In this embodiment, lateral travel limits are detected by use of the conductive flanges on the aluminum tool of FIG. 16 and 17 that is positioned over the spool. The tool is machined to precisely register on the spool and carry the location of the spool flange inner surfaces 27*a*, 27*b* radially outward into the path of the left and right parallel strands 38, 39 in their lateral travel.

In operation, the fiber guide is moved by a linear motor, laterally under encoder and servo 75 control by a computer near the surface of the fiber coil 22. At the limit of travel, one of the left or right parallel strands 38, 39 electrically contacts the inner surface of the tool outer flange 85, 86 which is co-planar with the inner surface of the bobbin flange 27*a*, 27*b* at which point, the servo 75 stops lateral motion in preparation for starting the next layer of winding.

FIG. 17 shows the tool 81 of FIG. 16 draped on the mandrel containing a non-conductive coil form or bobbin. The inner periphery 92 of the tool's outer flange is close to the outer periphery 94 of the left bobbin chuck 95. A right bobbin chuck 96 is shown in FIG. 16.

FIGS. 18–24 shows an alternative embodiment of the invention fiber guide. The fiber guide consists of a 'C' shaped or left pay guide arm 34 with wire attachment points at each extreme end of the pay guide arm. The attachment points consist of a calibrated and hardened spacer 40, such as that shown in FIG. 14, to set the distance between the left and right parallel strands 38, 39. Two hardened washers 52*a*, 52*b* to clamp the left and right parallel stands formed from two 0.004 diameter steel wires or guides into position to guide the fiber and two shoulder screws 49 for retaining and clamping the washers. It also has two rollers mounted in the middle of the arm to pre-align the optical fiber before it passes through the alignment wires.

Figure 18:
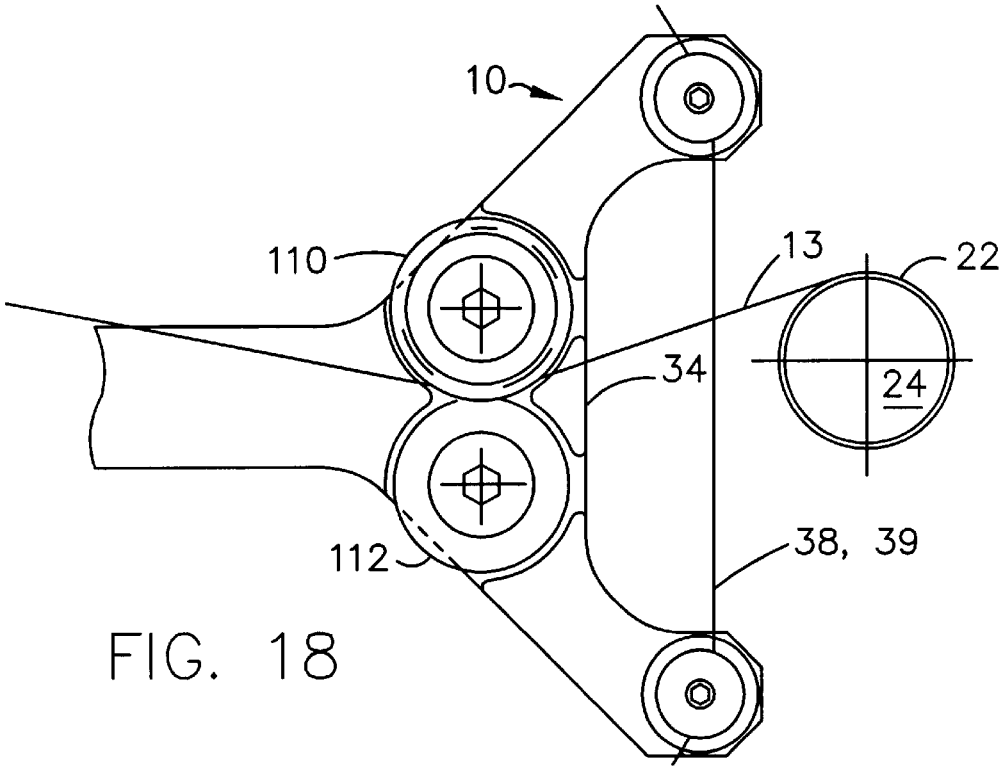
FIG. 18 is a side elevation view of a fiber guide in which the two parallel strands or guides 38, 39 are separated by a spacer washer.

FIG. 18 is a side elevation view of fiber guide 10 in which the two parallel strands or guides 38, 39 are separated by a spacer washer 40, (not shown). An optical fiber 13 is shown passing from the left, between flanged roller 110 and roller 112, between left and right strands 38, 39 to fiber coil 22 on spindle 24. The embodiment of FIG. 18 eliminates or simplifies the setup process by the use of simple spacers to set the wire gap, straight line wire position allows the use of a simple weight to set tension and overlapping ball bearings to pre-align the fiber and prevent accidental disengagement from a pre-aligned position.

Figure 19:
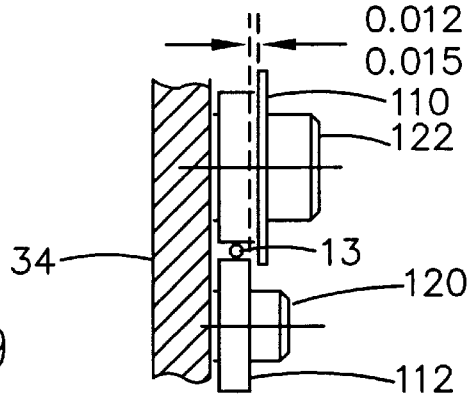
FIG. 19 is a front elevation of the fiber guide of FIG. 18 showing the dual clamps for griping and holding the fiber, the fiber passing between the rollers and out of the page, as an alternative for the guide pulley of FIGS. 3 and 17.

FIG. 19 is a front elevation of the fiber guide of FIG. 18 showing the dual clamps for griping and holding the fiber, the fiber passing between the, upper flanged roller 110, and a lower roller 112 and out of the page. The rollers are spaced by 0.012 to 0.015 inches. As shown, the fiber is maintained in tension against the lower surface of the upper flanged roller 110. While tension is retained the fiber can move left and is stopped by the bearing wall and to the right where it is stopped by the flange.

Figure 20:
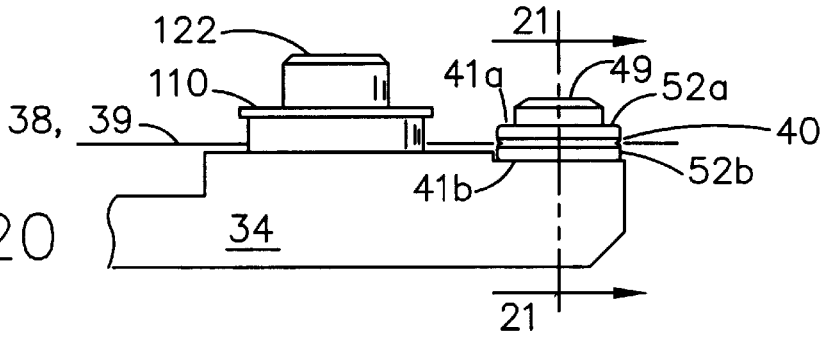
FIG. 20 is a top elevation view of FIG. 18 showing the left and right strands separated by a very thin spacer and clamped by two washers and secure by a fastener.

FIG. 20 is a top elevation view of the fiber guide of FIG. 18 showing the left and right strands 38, 39 separated by a very thin spacer 40 between the parallel strands and clamped by a fastener 49 as in FIG. 14. The left and right parallel strands are between shims or washers 52*a*, 52*b* to protect the opposing registration faces 41*a*, 41*b* and to grip the left and right parallel strands 38, 39 against spacer 40.

Figure 21:
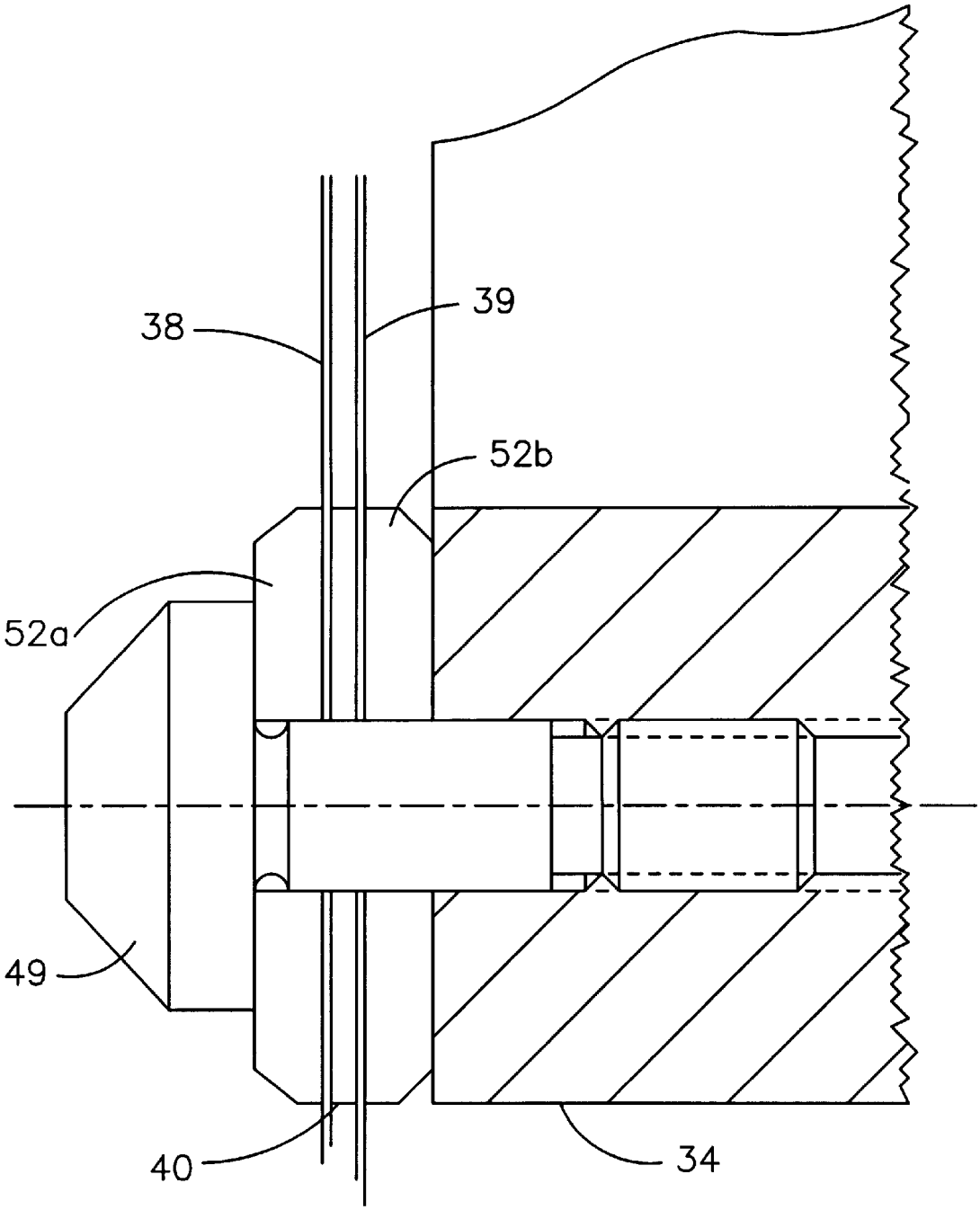
FIG. 21 is a schematic partial section of FIG. 20.

FIG. 21 is a schematic sectional view of FIG. 20 taken on section line 21, 21 to expand the view of the spacer 40 separating the left and right parallel strands 38, 39, the shims 52*a* and 52*b* and the fastener 49.

Figure 22:
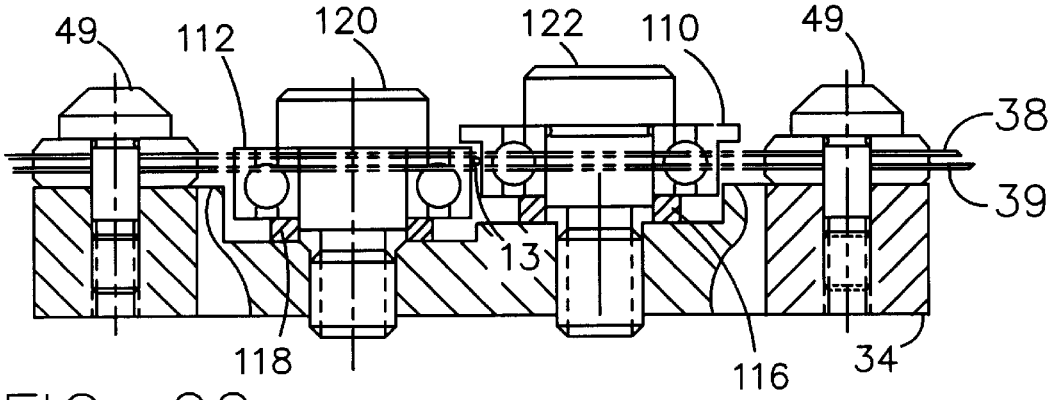
FIG. 22 is a schematic irregular section of FIG. 18 taken through each rotational axis.

FIG. 22 is an irregular sectional view of FIG. 18 taken on a line passing through each of four bearing centers. The upper flanged roller bearing 110 and the lower roller bearing 112 are shown. A first bearing spacer 116 is positioned under the upper flanged roller bearing 110 and a second bearing spacer 118 is shown positioned below the lower roller bearing 112. The spacers are machined to thickness for setting the height of the inner surface of the flange and two modified shoulder screws 120, 122 are for retaining and pre-loading the bearings.

Figure 23:
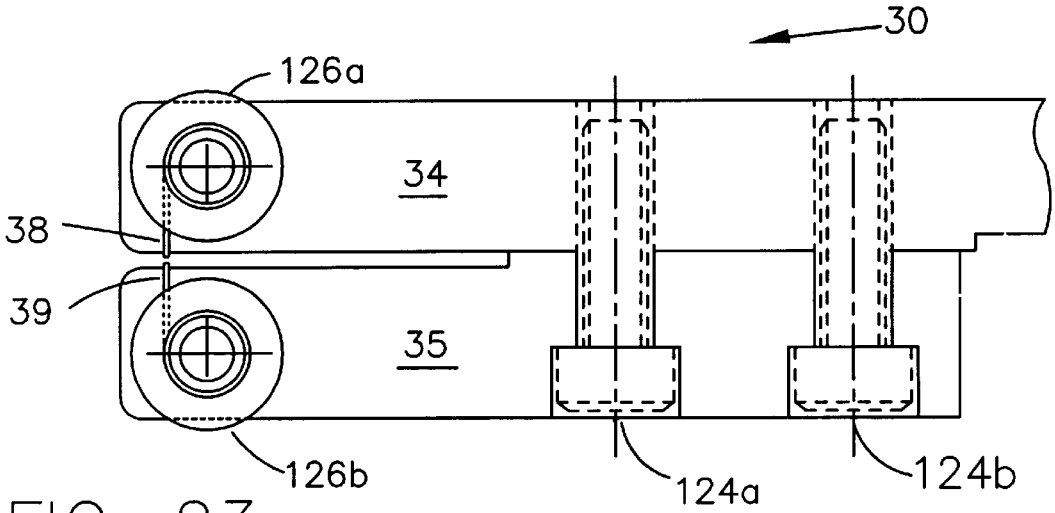
FIG. 23 is a partial schematic top view of an alternative embodiment of FIG. 18 modified to show one open throat.

FIG. 23 is a schematic top view of a portion of a fiber guide assembly as it would appear if one throat had to remain open as might be made necessary if coils were to be wound starting from the mid point of a roll of fiber stored on two equal bobbins such as quadrupole wound coils for fiber optic gyros.

The fiber guide of FIGS. 18–22 are for applications such as mandrels for fiber optic acoustic interferometers which may be wound with fiber from the end of a coil of fiber. In operation, the pay guide arm assembly 30 of FIGS. 23–24 is mounted to the hydrophone winding machine and guides the optical fiber onto the acoustic mandrels in such a way as to align the fibers next to each other for the sensing portion of the mandrel and also routes the fiber through spiral groove at each end of the mandrel.

Figure 24:
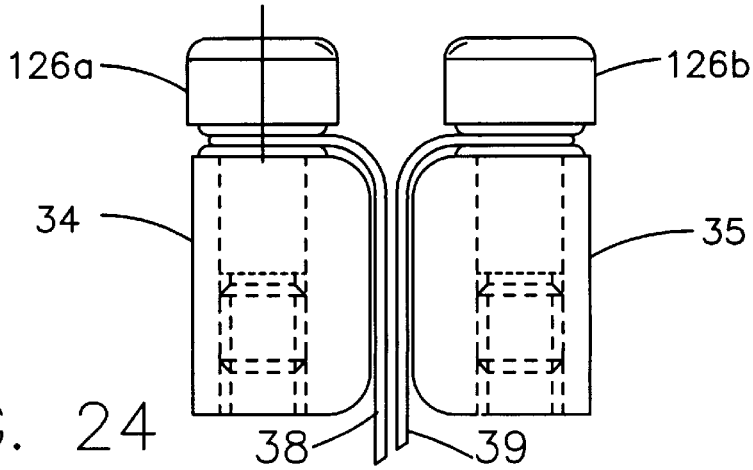
FIG. 24 is a side elevation view of FIG. 23 showing the open throat.

The alternate design of FIG. 23 and 24 is suitable for quadrupole wound fiber optic coils. In this alternative design for quadrupole winding, one side of the pay guide parallel wires is open to allow insertion of unbroken fiber. FIG. 23 and FIG. 24 show that one end of the 'C' shaped pay guide arm is separated into a left pay guide arm 34 and a right pay guide arm 35 with simple cap screws 124*a*, 124*b* to hold the arms together.

FIG. 23 is a front elevation of the schematic of FIG. 22. Cap screws 126*a*, 126*b* retain the left and right parallel strands 38, 39. The other end of the arm is closed as is previously described for the embodiment of FIGS. 18–21.

While the invention has been explained in connection with a single embodiment, it is intended that only the appended claims be used to limit the scope of this patent.

What is claimed is:

1. A fiber guide and automatic coil winding machine for spooling fiber from the automatic coil winding machine onto a spool comprising, in combination;

a rigid pay guide assembly having a receiving aperture with a top end and a bottom end, each end having a gap, the gap in at least the top end or the bottom end being closed, a left parallel strand and a right parallel strand spaced apart across the receiving aperture of the pay guide assembly;

tensioning means for attaching the left parallel strand and the right parallel strand to the pay guide assembly and for holding the strands in tension; and, a guide pulley carried by the pan guide assembly for guiding the fiber between the left and right parallel strands and onto an outer surface of a fiber coil being formed on the spool.

2. The fiber guide of claim 1 wherein the pay guide assembly comprises a left pay guide arm and a right pay guide arm, the pay guide arms being joined with their respective top and bottom ends together, the joined pay guide arms forming the receiving aperture.

3. The fiber guide of claim 2 wherein the left and right parallel strands are music wires; and the pay guide assembly has a gap opening for the guide pulley and fiber.

4. The fiber guide of claim 2 wherein the left and right pay guide arms have a hole to receive a threaded end of a hollow threaded standoff, the hollow threaded standoff having a cross hole therethrough for the left and right parallel strands; and, a rubber plug followed by, set screw inserted into the hollow standoff to securely bind the left and right parallel strands in the cross hole.

5. The fiber guide of claim 1 wherein the left and right parallel strands are, in the alternative, formed from piano or music wire.

6. The fiber guide of claim 1 wherein the gap in the top end is closed, and the gap in the bottom end is open.

7. The fiber guide of claim 1 wherein the gap in the top end is closed and the gap in the bottom end is closed.

8. The fiber guide of claim 7 further comprising a pivotal connection from the automatic coil winding machine to said pay guide assembly.

9. The fiber guide of claim 8 wherein the spool has a spool rotation axis and a predetermined window for receiving fiber, the window being bordered by a coil form or a spindle, the spindle having a surface and a left and right flange inner surface of predetermined height above the spindle surface, and wherein the coil winding machine further comprises:

servo means for moving the fiber guide parallel to the spool rotation axis as the spool is rotated.

10. The fiber guide of claim 9 wherein the left and right parallel strands are electrically insulated from the automatic coil winding machine; and, means for electrically sensing and teaching the servo means the limits of travel parallel to the rotation axis of said spool rotation axis to bring the left and right parallel strands to a corresponding left and right flange inner surface.

11. The fiber guide of claim 1 wherein the rigid pay guide assembly comprises two pay guide arms, with a gap between the pay guide arms at a top end and at a bottom end of the receiving aperture and wherein the left and right parallel strands are formed from piano or music wire; and, a spacer is fixed between the left and right parallel strands to fix the spacing of the left and right parallel strands to a predetermined width.

12. The fiber guide of claim 1 further comprising, means form anchoring the left and right parallel strands to the pay guide assembly, and left and right parallel strands tensioning means carried by the pay guide assembly to tension the left and right parallel strands.

13. The fiber guide of claim 1 wherein the pay guide assembly comprises a left and a right pay guide arm, each pay guide arm having a top end and a bottom end, a gap being formed between the top ends and bottom ends of the pay guide arms; the gaps being characterized to provide a top and bottom throat, each respective throat having a respective first and second side separated by a predetermined distance, each respective left and right parallel strand being in contact with a corresponding to and bottom side, at least one gap being closed by a thin spacer interposed between the left and right strands passing through a throat.

14. The fiber guide of claim 1 wherein the tensioning means comprise a pair of pivot plates joined to form a box, the box being pivotally connected to the pay guide assembly and to the left and right parallel strands; and, a spring connected between the box or pair of pivot plates and the pay guide assembly for drawing the left and right parallel strands into a tensioned condition, and a threaded screw engaging the box at a moment arm distance from the pivotal connection between the box and the pay guide assembly as to apply a torque to the box as the spring is extended by operation of the threaded screw.

15. A fiber guide for spooling glass fiber from an automatic coil winding machine onto a spool comprising in combination;

a rigid pay guide assembly having a receiving aperture and having a first end and a second end, a gap being formed at each end of the aperture to receive a left and right parallel strand the left and right strands being spaced apart by at least a first spacer, the left and right parallel strands being tightly stretched across the receiving aperture and anchored;

means for passing and tensioning fiber from a source of fiber between the left and right parallel strand for delivery onto the spool.

16. A fiber guide coupled to a winding machine for winding optical fiber onto a spool, the fiber guide comprising, in combination:

a rigid pay guide assembly having a receiving aperture;

a left and a right parallel strand of wire spaced apart across the receiving aperture of the pay guide assembly; and, a spacer or washer or shim fixed between at least a first pair of left and right parallel strands passing through a throat to fix the spacing of the first pair of left and strands wires in the throat to a predetermined width.

17. The fiber guide of claim 16 further comprising:

a spacer or washer or shim fixed between the left and right parallel strands passing though each throat to fix the spacing of the left and right parallel strands to a predetermined width.

18. The fiber guide of claim 16 further comprising:

a guide pulley carried by the pay guide assembly for guiding the glass fiber from the winding machine onto said spool via the space between the left and right parallel strands; and, a pivotally mounted connection between the winding machine and said pay guide assembly.

19. The fiber guide of claim 16 further comprising:

a guide pulley carried by the pay guide assembly for guiding the fiber between the left and right parallel strands and onto a spool;

additional shims or spacers or washers on each side of the washer spacing the left and right parallel strands to protect the pay guide assembly.

20. A fiber guide for spooling fiber from an automatic coil winding machine onto a spool comprising in combination:

a rigid pay guide assembly having a generally arcuate opening and comprising two similar sections held together with a gap between the sections;

a left and right parallel strand of wire tightly stretched across the receiving aperture of the arc and anchored;

a spacer or washer or shim fixed between at least a first pair of left and right parallel strands passing through a throat to fix the spacing of the left and right parallel strands in the throat to a predetermined width;

a spool for receiving the fiber from between the left and right parallel strands;

a guide pulley rotatably mounted on a guide pulley shaft, the guide pulley shaft being carried by the pay guide assembly, the guide pulley rotating on the shaft to guide the fiber from the winding machine onto the spool via the space between said left and right parallel strands;

a guide pulley bearing on the shaft for rotatably supporting the guide pulley; and, means for connecting the winding machine and said pay guide assembly.

21. A fiber guide for spooling glass fiber from an automatic coil winding machine onto a spool comprising in combination;

a rigid pay guide assembly having a receiving aperture and having a first end and a second end, a gap being form at each end of the aperture to receive a left and right parallel strand, the left and right strands being spaced apart by at least a first thin spacer, the strands passing between shims or washers, a fastener passing through the shims or washers and the thin spacer into a pay guide end to grip the parallel stands between the shims or washers and the thin spacer, the left and right parallel strands being tightly stretched across the receiving aperture and anchored;

means for passing and tensioning fiber from a source of fiber between the left and right parallel strand for delivery onto the spool.

* * * * *